US006772828B1

(12) United States Patent
Chen

(10) Patent No.: US 6,772,828 B1
(45) Date of Patent: Aug. 10, 2004

(54) COOLING FIN ASSEMBLY

(76) Inventor: Li-Chuan Chen, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/374,987

(22) Filed: Feb. 28, 2003

(51) Int. Cl.[7] ..... H05K 7/20

(52) U.S. Cl. ..... 165/78; 165/80.3; 165/185; 257/722; 361/704

(58) Field of Search ..... 165/78, 80.3, 185; 257/722; 361/704

(56) References Cited

U.S. PATENT DOCUMENTS 5,558,155 A * 9/1996 Ito ..... 165/80.3
6,340,056 B1 * 1/2002 Huang et al. ..... 165/185
6,644,397 B1 * 11/2003 Shen ..... 165/185
6,651,733 B1 * 11/2003 Horng et al. ..... 165/80.3
6,672,379 B1 * 1/2004 Wang et al. ..... 165/185

* cited by examiner

*Primary Examiner*—Leonard Leo

(57) ABSTRACT

A cooling fin assembly includes a cooling fin in a U-shaped rectangular tank disposed with fastening lugs at the front and rear of the upper surface thereof; the sides of the U-shaped tank extended downward with notches provided at the front and rear of the inner edges thereof; skew protruding fastening flanges provided at the interior of the notches to correspond with the aforesaid fastening lugs at the upper surface of the U-shaped tank. During assembly, the fastening lugs of a cooling fin are fitted around the fastening flanges of another cooling fin, so as to display the outer edges of the cooling fin as even planes, thus forming larger areas for heat dissipation. In addition, the notches and the fastening flanges are hidden designs that enable a cooling fan disposed at the cooling fin to decrease air friction and increase air force, thereby obtaining an optimal cooling effect.

1 Claim, 4 Drawing Sheets

COOLING FIN ASSEMBLY

BACKGROUND OF THE INVENTION (a) Field of the Invention

The invention relates to a cooling fin assembly, and more particularly, to a cooling fin assembly having an optimal cooling effect and practical values.

(b) Description of the Prior Art

Referring to FIG. 1 showing a convention schematic view of a prior cooling fin 1, wherein the top portion 11 thereof is generally an accidented design and the bottom portion 12 thereof is an even level. At the front and rear edges corresponding to the top and bottom portions 11 and 12 are disposed with protruding flanges 13 so as to connect a flange 13 to another flange 13 during the assembly of a cooling fin 1 to another cooling fin 1.

Although the aforesaid cooling fin assembly is capable of dissipating heat, the protruding flanges 13 left exposed of the cooling fin 1 not only appear as unappealing but also reduce the area for heat absorption and increase air friction. The air force of cooling fan disposed on the cooling fin is affect as a result, and further lowering the cooling effect of the cooling fin 1.

SUMMARY OF THE INVENTION

In the view of the above, an object of the invention is to provide a cooling fin that overcomes the above shortcomings while having better practical values for the industrial use.

To accomplish the above object, the cooling fin in accordance with the invention is a U-shaped rectangular tank disposed with fastening lugs at appropriate locations at the front and rear of the upper surface thereof; the sides of the U-shaped tank are extended downward with notches provided at appropriate locations at the front and rear of the inner edges thereof; and skew protruding fastening flanges are provided at the interior of the notches to correspond with the aforesaid fastening lugs at the upper surface of the U-shaped tank.

During the assembly of one cooling fin to another cooling fin, the fastening lugs of a cooling fin are fitted around the fastening flanges of another cooling fin. At this point, the fastening lugs are fixed into the notches, and the hollow spaces at the middle of the fastening lugs exactly accommodate the fastening flanges at the notches, so as to display the outer edges of the cooling fin as even planes, thus forming larger areas for heat dissipation. In addition, the notches and the fastening flanges are hidden designs that enable a cooling fan disposed at the cooling fin to decrease air friction and increase air force thereof, thereby obtaining an optimal cooling effect.

DETAILED DESCRIPTION OF THE PREFERRED EMBODIMENTS

To better understand the object, characteristics and functions of the invention, detailed descriptions shall be given with the accompanying drawings hereunder.

Figure 1:
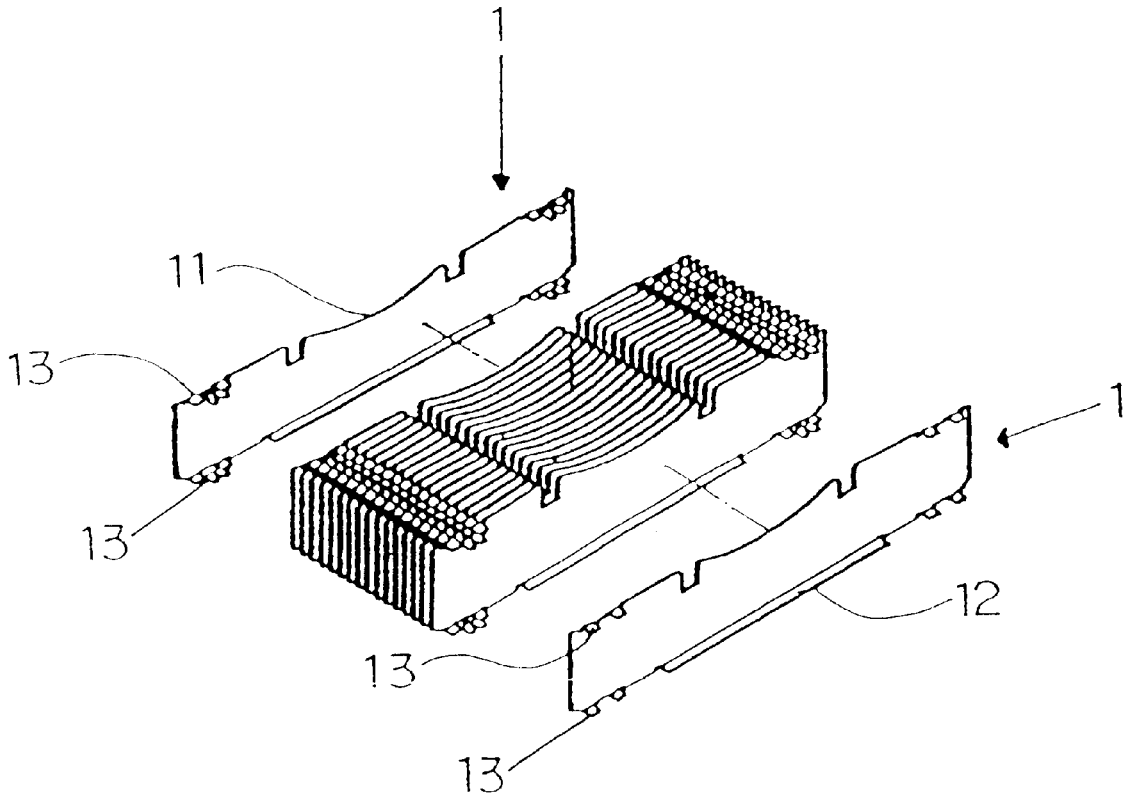
FIG.1 Prior Art
FIG. 1 shows a conventional schematic view of a prior art.
Figure 2:
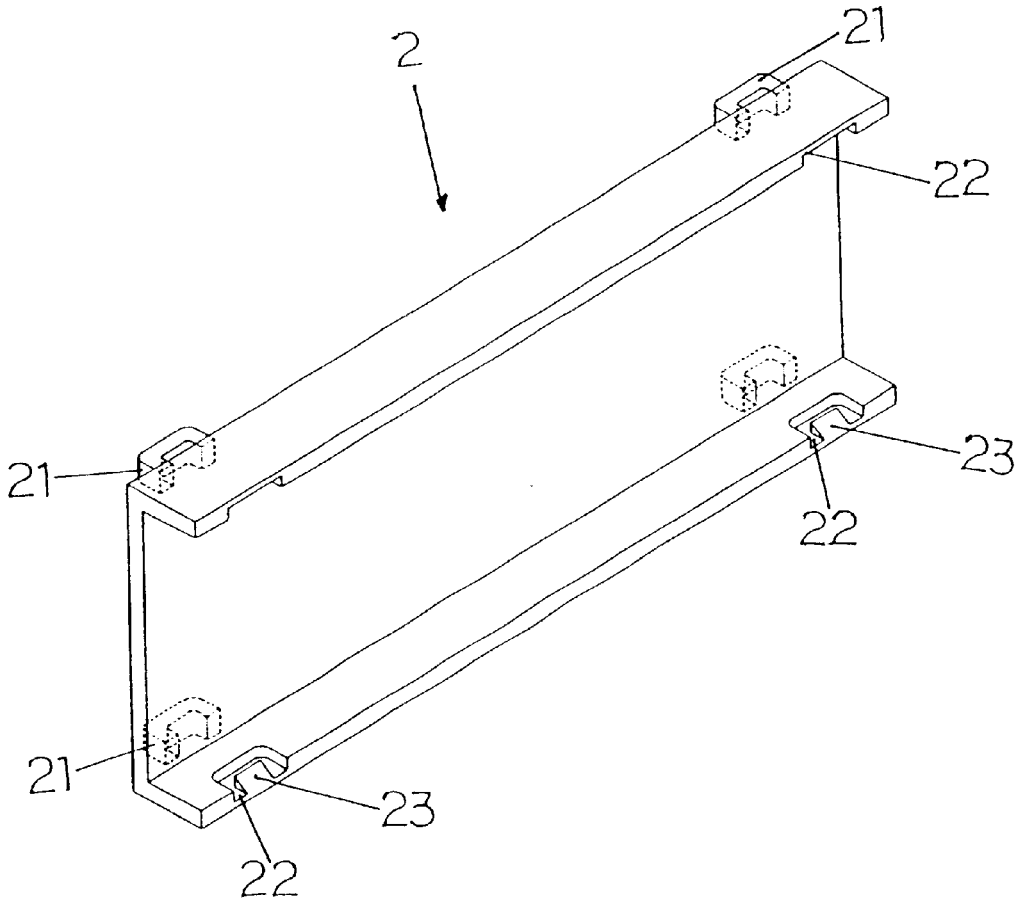
FIG. 2 shows an elevational view according to the invention.

Referring to FIG. 2, in order to provide a better cooling effect, the characteristics of the cooling fin 2 in accordance with the invention are that: the cooling fin 2 is a U-shaped rectangular tank disposed with fastening lugs 21 at appropriate locations at the front and rear of the upper surface thereof; the sides of the U-shaped tank 2 are extended downward with notches 22 provided at appropriate locations at the front and rear of the inner edges thereof; and skew protruding fastening flanges 23 are provided at the interior of the notches 22 to correspond with the aforesaid fastening lugs 21 at the upper surface of the U-shaped tank.

Figure 3:
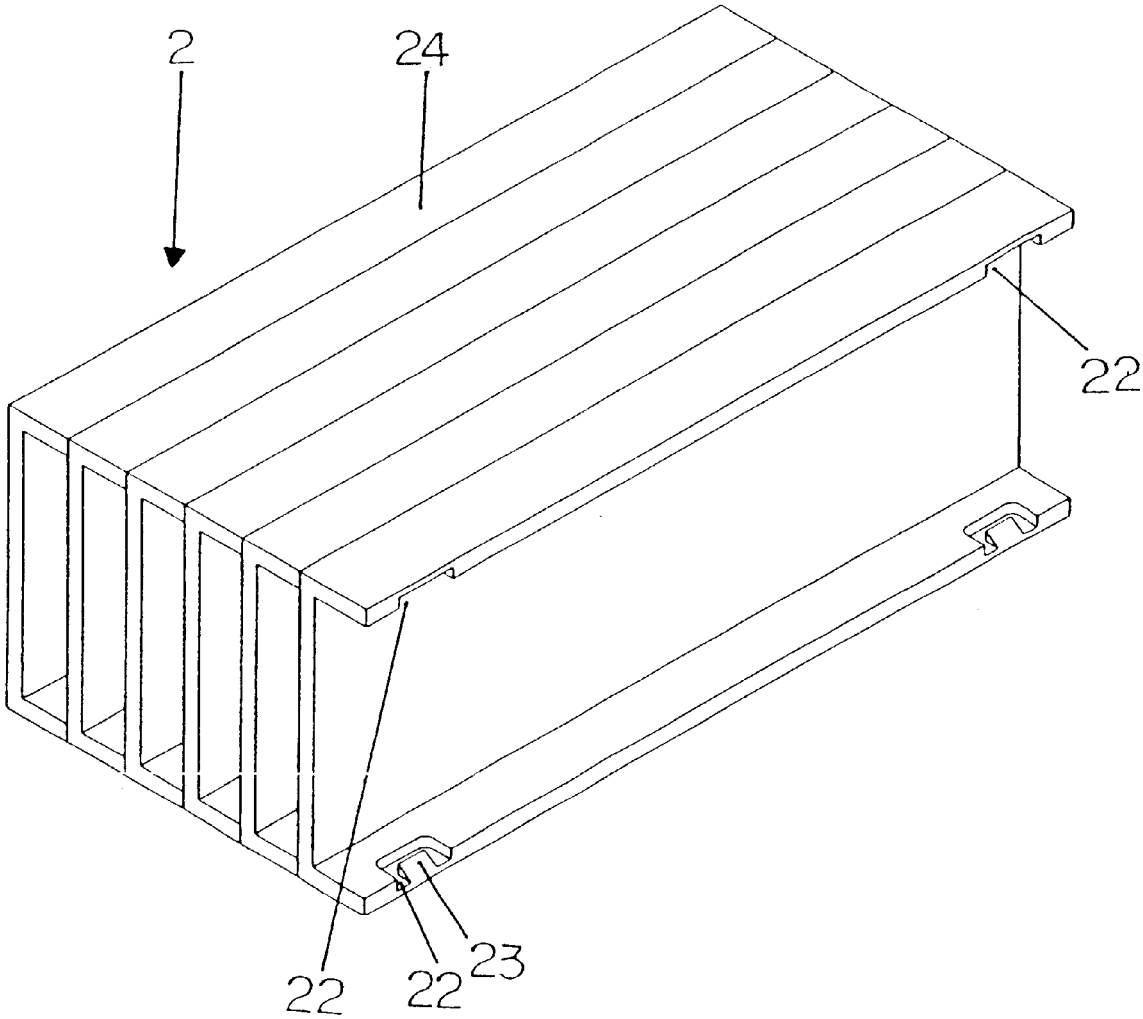
FIG. 3 shows an elevational view illustrating the assembly according to the invention.
Figure 4:
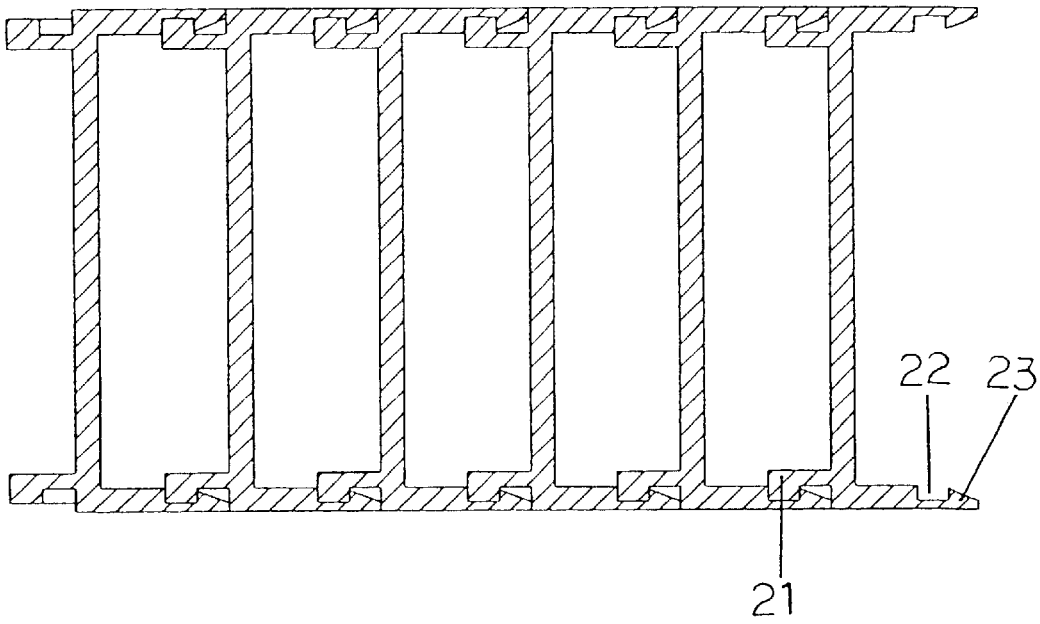
FIG. 4 shows a sectional view illustrating the assembly according to the invention.

Referring to FIG. 3 showing the assembly of a cooling fin 2 and another cooling fin 2, the fastening lugs 21 of a cooling fin 2 are fitted around the fastening flanges 23 of another cooling fin 2. At this point, the fastening lugs 21 are fixed into the notches 22 as shown in FIG. 4, and the hollow spaces at the middle of the fastening lugs 21 exactly accommodate the fastening flanges 23 at the notches 22, so as to display the outer edges of the cooling fin as even planes 24, thus forming larger areas for heat dissipation. In addition, the notches 22 and the fastening flanges 23 are hidden designs that enable a cooling fan disposed at the cooling fin 2 to decrease air friction and increase air force thereof, thereby obtaining an optimal cooling effect.

Conclusive from the above, the cooling fin in accordance with the invention is evidently superior in economical and practical than the prior art. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A cooling fin assembly comprising cooling fins having an optimal cooling effect, and the characteristics thereof are that:

the cooling fin is a U-shaped rectangular tank disposed with fastening lugs at appropriate locations at the front and rear of the upper surface thereof; the sides of the U-shaped tank are extended downward with notches provided at appropriate locations at the front and rear of the inner edges thereof; and skew protruding fastening flanges are provided at the interior of the notches to correspond with the aforesaid fastening lugs at the upper surface of the U-shaped tank; and during the assembly of one cooling fin to another cooling fin, the fastening lugs of a cooling fin are fitted around the fastening flanges of another cooling fin, so as to display the outer edges of the cooling fin as even planes, thus forming larger areas for heat dissipation; and the notches and the fastening flanges are hidden designs that enable a cooling fan disposed at the cooling fin to decrease air friction and increase air force thereof, thereby obtaining an optimal cooling effect.

* * * * *